US005765572A

United States Patent [19]

Paget et al.

[11] Patent Number: 5,765,572

[45] Date of Patent: Jun. 16, 1998

[54] HAIR TREATING AND/OR SETTING APPARATUS PROVIDED WITH A DEVICE FOR DRAWING OUT A CURL

[75] Inventors: Monique Paget, Coluiro ot Cuire; Daniel Bontoux, Saint Genis Lavel, both of France

[73] Assignee: SEB S.A., Ecully, France

[21] Appl. No.: 532,750

[22] PCT Filed: Apr. 6, 1994

[86] PCT No.: PCT/FR94/00386

§ 371 Date: Oct. 6, 1995

§ 102(e) Date: Oct. 6, 1995

[87] PCT Pub. No.: WO94/22343

PCT Pub. Date: Oct. 13, 1994

[30] Foreign Application Priority Data

Apr. 6, 1993 [FR] France ..... 93/04291

[51] Int. Cl.[6] ..... A45D 2/30

[52] U.S. Cl. ..... 132/210; 132/210; 132/266; 132/268; 132/239; 132/254

[58] Field of Search ..... 132/207, 210, 132/226, 237, 238, 239, 240, 241, 242, 254, 266, 268, 211, 232

[56] References Cited

U.S. PATENT DOCUMENTS

| | | | |
|---|---|---|---|
| 563,784 | 7/1896 | Morley | 132/237 |
| 1,579,952 | 4/1926 | Rankin . | |
| 1,657,306 | 1/1928 | Gursky . | |
| 2,075,652 | 3/1937 | Leland | 132/238 |
| 2,159,131 | 5/1939 | Burns . | |
| 2,279,996 | 4/1942 | Kantor | 132/242 |
| 2,448,263 | 8/1948 | Hannon | 132/238 |
| 4,192,328 | 3/1980 | Barradas et al. | 132/232 |
| 4,197,608 | 4/1980 | Holley et al. | 132/118 |
| 4,281,673 | 8/1981 | Miller . | |
| 4,477,716 | 10/1984 | Thaler et al. | 132/232 |

FOREIGN PATENT DOCUMENTS

| | | | |
|---|---|---|---|
| 171073 | 4/1952 | Australia | 132/226 |
| 2 082 908 | 3/1982 | United Kingdom . | |
| 2 130 880 | 6/1984 | United Kingdom . | |

*Primary Examiner*—Todd E. Manahan
*Assistant Examiner*—E. Robert
*Attorney, Agent, or Firm*—Loeb & Loeb LLP

[57] ABSTRACT

A preferably hand-held hair treating and/or setting apparatus comprising, arranged around a main body, a handle (1), a hair curling member (2) with a longitudinal axis (x–x'), and at least one movable clip (10) for clamping a lock of hair against the hair curling member (2), the clip (10) being freely movable along the curling member (2) between two abutment positions so that it can draw out the treated lock (M') in its initial treatment condition. The apparatus is useful for setting hair.

18 Claims, 3 Drawing Sheets

HAIR TREATING AND/OR SETTING APPARATUS PROVIDED WITH A DEVICE FOR DRAWING OUT A CURL

BACKGROUND OF THE INVENTION

The present invention relates to the general technical field of hair treating and/or setting apparatus, such as those permitting the functions of hair dressing, setting and curling for example.

The present invention concerns a hair treating and/or setting apparatus, preferably hand-held, comprising, arranged starting from a main body, a handle, a hair curling member, preferably mounted for free rotation on the main body around its longitudinal axis, and at least one movable clip for clamping a lock of hair against the member.

The apparatus according to the invention is more particularly intended to assure a function of immobilizing a lock of hair in order to assure or facilitate curling of a lock of hair. In this connection, the hair treating and/or setting apparatus according to the invention concerns more specifically, but not exclusively, curling apparatus. The apparatus according to the invention can however, obviously, comprise, in association on the principal body constituting it, supplemental devices adapted to perform other hair treating and/or setting functions such as a brush, or any other means capable of supplying heat, steam or a treatment product. The apparatus according to the invention thus comprises, equally, apparatus such as hair dressing or curling irons provided or not provided with means for heating or for generating steam.

It is also known in order to facilitate the curling of a lock of hair around a cylindrical body, to furnish the latter with projections, teeth or other elements capable of penetrating into the lock of hair in order to facilitate its adherence and immobilization on the cylindrical body. Such a device presents, however, the drawback of requiring use of both of the user's hands, one to hold the lock of hair pressed against the cylindrical body, the other to turn the apparatus around the cylindrical body. These devices are in consequence generally considered to be difficult to use, and at least necessitate a minimum dexterity.

In order to improve the positioning and the immobilization of the lock of hair on the cylindrical body it has in consequence already been proposed to resort to a movable clip fixed to said body in order to assure clamping of the lock of hair. Such a clip thus permits applying and immobilizing the lock of hair onto the body and thus greatly facilitates the always tricky phase of starting curling of the lock. The prior art device implementing the standard principle of the mobile clip thus presents a notable improvement in handling in comparison with the device mentioned previously. Resort to a movable clip does not however permit remedying the problems of the separation of the treated and curled lock starting from the cylindrical body, without at least partially destroying the structure and quality of the remaining curls. In effect, the separation step requires an unrolling of the curl in order to release it.

It has already been proposed in order to at least partially solve this problem, to furnish the cylindrical bodies with a certain number of retractable projections intended to facilitate the separation of the curled lock. It has been found that at least a portion of the hair always adheres partially to the projections, and that if the uncurling of the lock can be limited, it is always necessary to assure a certain manual guiding, starting from the rolling, and even at the end of the operation during separation. The devices equipped with retractable projections are moreover more complex to produce at the mechanical level, and by the same have an increased cost.

SUMMARY OF THE INVENTION

The object of the invention aims, in consequence, to propose a new hair treating and/or setting apparatus which does not present the drawbacks of prior systems mentioned previously, and which is able to assure in a simple, effective and rapid manner the separation of the treated and curled lock without a complicated manipulation on the part of the user.

Another object of the invention aims at furnishing a hair treating and/or setting apparatus having a particularly simplified design on the mechanical level.

Another object of the invention aims to propose a new hair treating and/or setting procedure in which the step of separating the curled lock is obtained without excessive manipulation on the part of the user, in a simple and rapid manner.

Other objects assigned to the invention are achieved with the aid of a hair treating and/or setting apparatus, preferably hand-held, comprising, arranged starting from a principal body:

a handle;

a hair curling member presenting a longitudinal axis;

at least one movable clip for clamping the lock of hair against the hair curling member characterized in that the movable clip is mounted in a manner to be freely displaceable on the hair curling member between two abutment positions to assure the extraction of the treated lock in its initial treatment state.

The objects assigned to the invention are equally achieved with the aid of a hair treating and/or setting process consisting of:

immobilizing a lock of hair by clamping between a clip and a curling body;

rolling the immobilized lock on the curling body, then effectuating the treatment of the lock characterized in that it consists of, after treatment, separating the curl from the curling body by translation of the clip on said body in a manner such that the curl is freely suspended on the clip.

BRIEF DESCRIPTION OF THE DRAWING

Other particularities and advantages of the invention will appear and become apparent in greater detail from a reading of the description given hereafter, in reference to the attached drawings, given by way of illustrative and nonlimiting examples in which.

DESCRIPTION OF THE PREFERRED EMBODIMENTS

Figure 1:
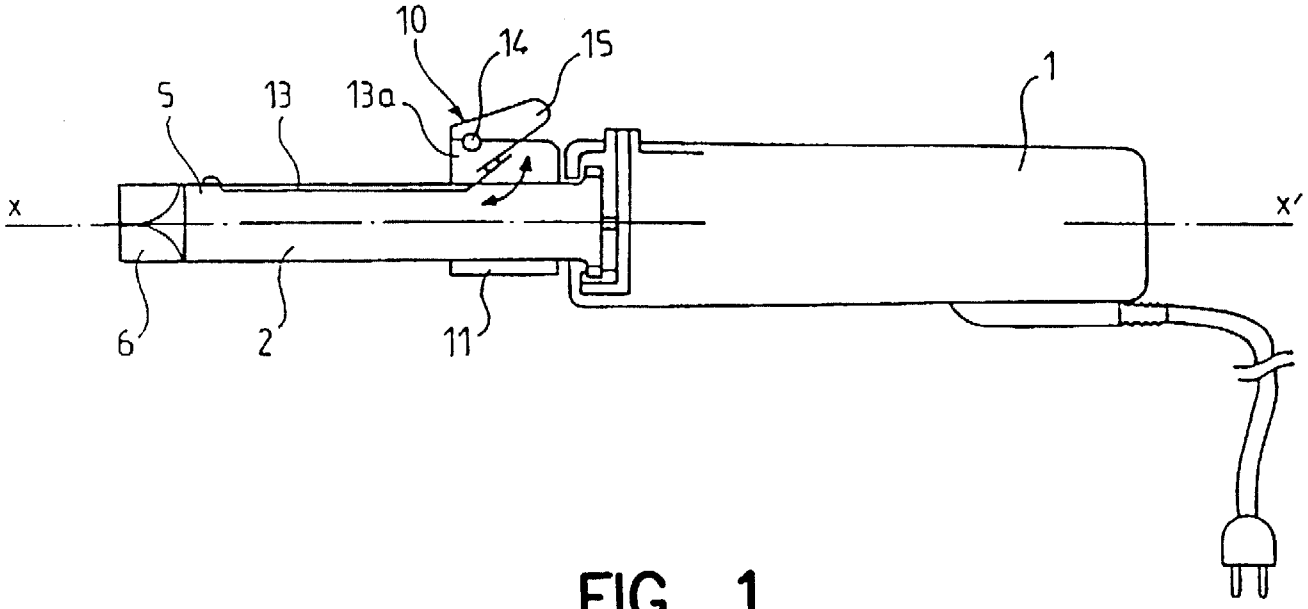
FIG. 1 shows according to a longitudinal transverse cross section a view of an apparatus according to the invention.

The hair treating and/or setting apparatus according to the invention, such as the curling apparatus shown in FIGS. 1 to 5, comprises a handle 1 constituted by a handle intended to be gripped by the hand of the user. In the particular exemplary embodiment shown in FIGS. 1 to 5, the handle 1 forms the main body of the apparatus starting from which are arranged different pieces constituting it. In the particular embodiment shown, the handle 1 is for example constituted by a cylindrical body having a longitudinal axis x–x', on which is mounted, preferably free to rotate around said axis x–x', a hair curling member 2. This latter is advantageously in cylindrical form, aligned with the axis x–x' of the handle 1 and connected to a means 3 for control and blocking of the rotation of said hair curling member 2. By way of a variation, the hair curling member 2 can be fixed with respect to the main body, setting of the hair being obtained by rotating the totality of the apparatus. In the example shown, the control and blocking means 3 are constituted by a control button having two positions assuring the blocking or the freeing of the rotation of the hair curling member 2 around its axis of rotation x–x'. By way of a variation, the hair curling member 2 can be connected to a locking mechanism housed in the handle 1 and permitting an engagement or disengagement of the hair curling member 2. By way of a complementary variation, the hair curling member 2 can be connected to an electric motor assembly capable of assuring its rotation.

The hair curling member 2 can be provided at its periphery with a series of grooves 4 (FIGS. 2 to 5), or equivalent means, capable of aiding the attachment of a lock of hair, or of opposing their sliding. In the example illustrated, the grooves 4 are longitudinal, but it is obvious that any type of means capable of assuring a function of opposing sliding is envisionable.

The hair curling member 2 comprises at the extremity 5 opposed to the extremity of connection with the handle 1, a button 6 for manual control of the rotation of said hair curling member 2.

The hair treating and/or setting apparatus according to the invention also comprises at least one movable clip 10 intended for clamping a lock of hair M on the peripheral surface of the hair curling member 2. The movable clip 10 is mounted on the hair curling member 2 in a manner to be freely displaceable on this latter between two abutment positions. Advantageously, the movable clip 10 is displaceable along the longitudinal axis x–x' of the hair curling member 2, by the intermediary of a slide 11 movably mounted on the hair curling member 2.

In the preferred embodiment of the invention, such as shown in FIGS. 1 to 5, the slide 11 is constituted by an annular ring surrounding the hair curling member 2.

By way of variation, the slide 11 can be constituted by a piece extending on only a part of the periphery of the hair curling member 2 and can be guided and fixed to this latter by the intermediary of a longitudinal slot (not shown in the drawings).

The movable clip 10 is intended to assure the clamping of the lock of hair M on the hair curling member 2 by the intermediary of a compression arm 13 extending along the axis x–x' and intended to be applied longitudinally onto the periphery of the hair curling member 2. The compression arm 13 is an extension of an intermediate piece 13*a* for fixation on the slide 11, at the interior of which is housed an axis 14 substantially normal to the axis x–x'. The clip 10 comprises at its end opposite to the compression arm 13 a control head 15 which is an extension of the intermediate piece 13*a* and intended to be manually operated in order to permit the rotation of the clip 10 around the axis 14. In a manner know per se, the clip 10 is mounted on the slide 11 in association with an elastic restoring means (not shown in the figures) such as a leaf or a spring assuring the permanent elastic return of the compression arm 13 against the periphery of the hair curling member 2. In its working position such as shown for example in FIGS. 1 and 3, in which the clip assures the clamping and the immobilization of the curl M, the compression arm 13 extends substantially over a length equal to that of the hair curling member 2, the slide 11 being mounted in a manner to slide between two abutment positions corresponding to the two extremities of the hair curling member 2. In an advantageous manner, the hair curling member 2 comprises at its extremity 5 an abutment piece (not shown in the figures) preventing complete removal of the slide 11.

The function of an apparatus according to the invention.

Figure 2:
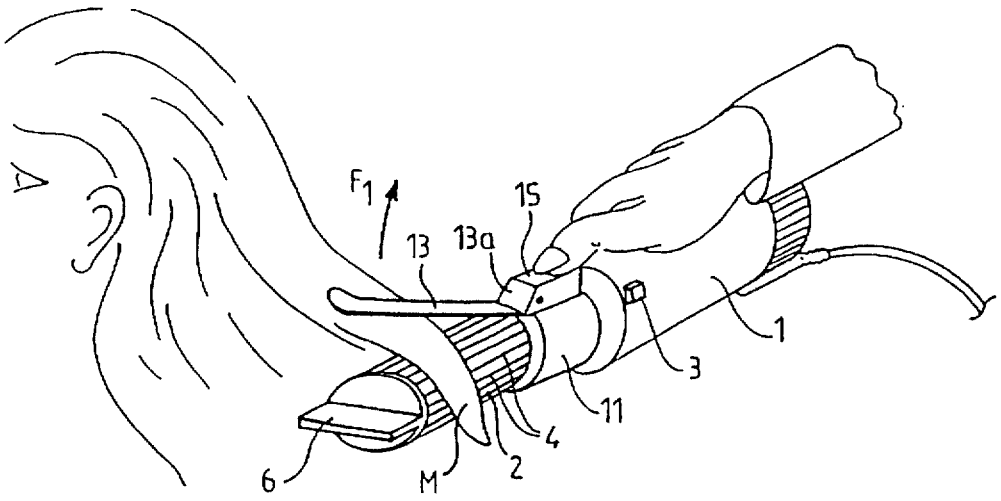
FIG. 2 shows according to a perspective view the step of placing a lock of hair on the apparatus according to the invention.
Figure 3:
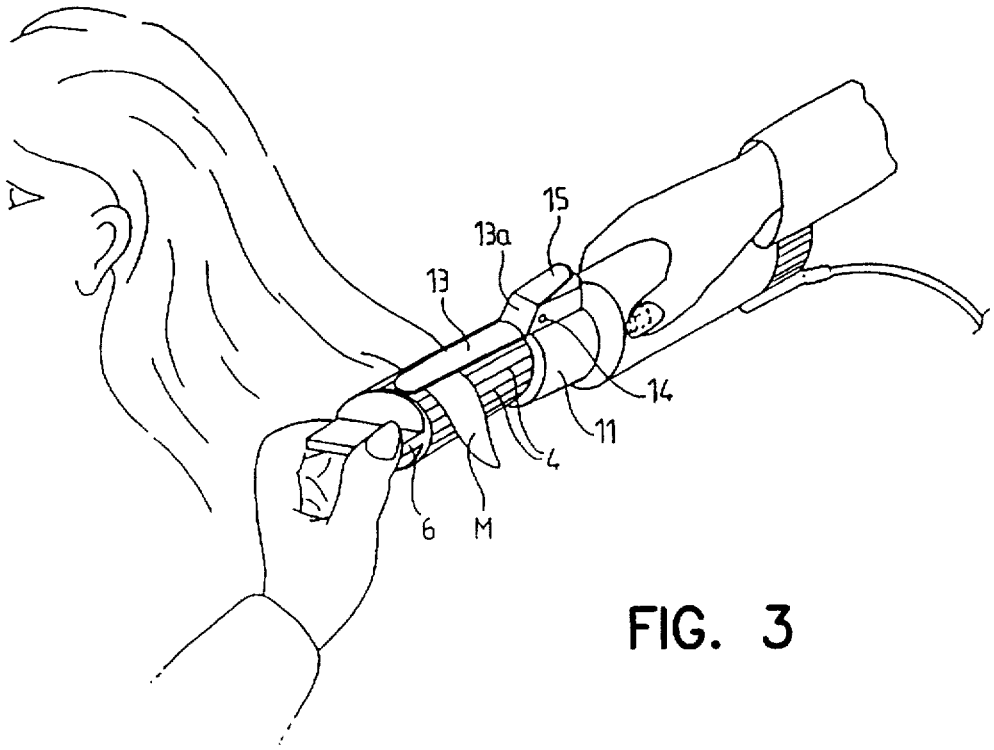
FIG. 3 shows according to a perspective view, the step of starting of rolling of the curl on an apparatus according to the invention.
Figure 4:
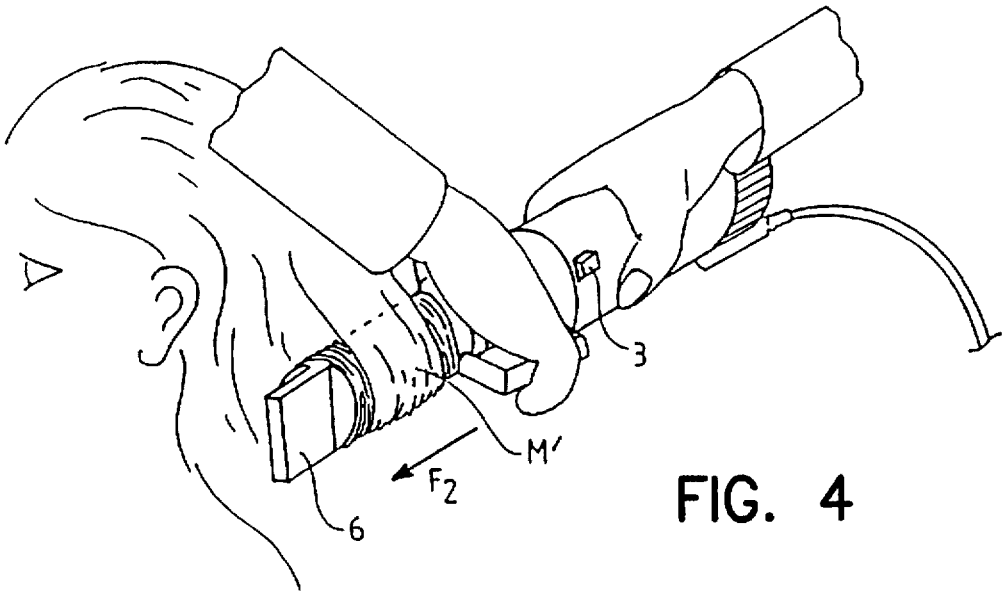
FIG. 4 shows according to a perspective view, the start of the step of separation and extraction of a lock of hair on an apparatus according to the invention.

The user grips the apparatus with one hand via the handle 1 such as shown in FIG. 2, and presses against the head 15 in a manner to assure the release of the clip 10 by rotation of the compression arm 13 in the direction of the arrow F1 around the axis 14. This permits the user to put in place against the compression arm 13 and the hair curling member 2 a lock M which is then immobilized by the release of the head 15 (FIG. 3). The operation of placing of the lock M can be effectuated with a single hand because it is sufficient to raise the lock M directly with the hair curling member 2. The release of the head 15 permits the compression arm 13 to be applied against the surface of the hair curling member 2 and to immobilize the lock M while leaving one hand of the user free for any control or assistance action.

The user can then press on the control means 3 (FIG. 3) permitting to assure the disengagement of the hair curling member 2. Preferably simultaneously, the user grips with the other hand the button 6, the rotation of which around the axis x–x' permits rolling the lock M on the hair curling member 2. The user then effectuates the appropriate treatment of the lock M, such as the application of steam, dye or heat.

Figure 5:
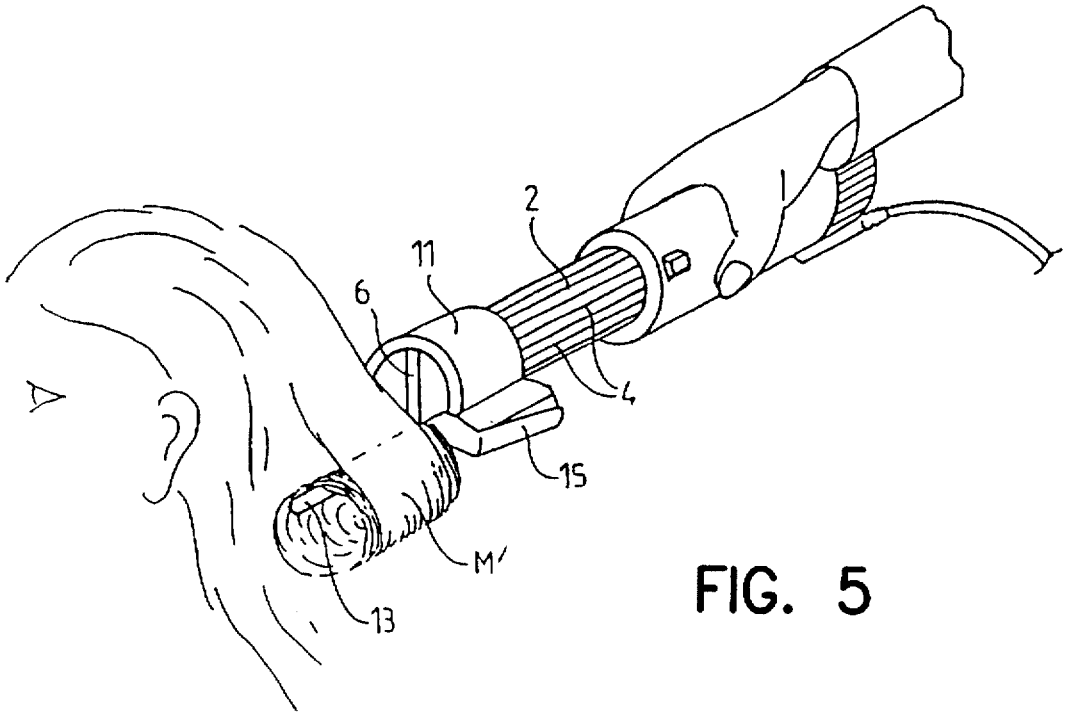
FIG. 5 shows according to a perspective view the final extraction step of the treated lock on an apparatus according to the invention.

After treatment of the lock M, the user grips with their free hand (FIG. 4) the assembly constituted by the slide 11 and the clip 10 in order to separate the treated or curled lock M' from said hair curling member 2 by translation of the clip 10 on said member 2 in a manner that the lock M' is freely suspended on the clip 10 (FIG. 5). During the course of this step the slide 11 undergoes a translation movement in the direction of the arrow F2 corresponding to a sliding of the clip 10 along the longitudinal axis x–x' of the hair curling member 2 permitting to assure the extraction of the treated lock M' without having to unroll it. The sliding of the clip 10 is effectuated over a sufficient length, and for example substantially along the entirety of the length of the hair curling member 2 in a manner to permit a complete disengagement of the treated lock M' leading, such as shown in FIG. 5, to a position of free suspension of the treated lock M' on the compression arm 13.

The hair treating and/or setting apparatus according to the invention, as well as the corresponding treatment procedure, assures a complete extraction of the treated or curled lock M' without having to assure its unrolling, i.e. without having to act in any manner on the structure of the treated lock M' itself. This latter is thus conserved integrally in its initial treatment state, i.e. for example rolled or curled, while the rolling and extraction manipulations have been particularly simplified.

By way of a preferred variation, the hair curling member 2 can be realized partially or advantageously completely of a plastic material, such as PBT, polyamide, filled or not, or polypropylene.

We claim:

1. Hair treating apparatus, for hand-held use, comprising:

a handle (1)

a hair curling member (2) having a longitudinal axis (x–x'), and first and second opposed ends spaced apart along the longitudinal axis, the first end of said curling member being supported by said handle in a manner to permit said curling member to be rotated relative to said handle about the longitudinal axis, and said curling member having a manual control element fixed at the second end for gripping by one hand of a user at least one movable clip (10) for clamping a lock of hair against the curling member (2), wherein the movable clip (10) is mounted in a manner to be freely displaceable on the curling member (2) between two abutment positions to assure extraction of the lock (M') in an initial treatment state; and control and blocking means for selectively blocking or freeing rotation of said curling member relative to said handle.

2. Apparatus according to claim 1 wherein the at least one movable clip (10) is displaceable along the longitudinal axis (x–x') of the curling member (2).

3. Apparatus according to claim 2 wherein the at least one movable clip (10) is mounted on the curling member (2) by the intermediary of a slide (11).

4. Apparatus according to claim 3 wherein the slide (11) is constituted by a ring surrounding the curling member (2).

5. Apparatus according to claim 4 wherein the slide (11) is mounted for sliding between two abutment positions, corresponding to the extremities of the curling member (2).

6. Apparatus according to claim 1 further comprising a slide (11) supporting at least one the movable clip (1) on the curling member (2).

7. Apparatus according to claim 6 wherein the slide (11) is constituted by a ring surrounding the curling member (2).

8. Apparatus according to claim 7 wherein the slide (11) is mounted for sliding between two abutment positions, corresponding to the extremities of the curling member (2).

9. Apparatus according to claim 6 wherein the slide (11) is mounted for sliding between two abutment positions, corresponding to the extremities of the curling member (2).

10. Apparatus according to claim 1 wherein the curling member (2) is substantially cylindrical.

11. Apparatus according to claim 1 wherein the curling member (2) is mounted for free rotation on the handle around its longitudinal axis (x–x').

12. Apparatus according to claim 1 wherein the curling member (2) is of plastic material.

13. Apparatus according to claim 1 wherein said at least one movable clip (10) extends along the axis of the curling member (2) over a length substantially equal to the length of said curling member.

14. Apparatus according to claim 1 wherein said control and blocking means are manually actuatable to permit rotation of said curling member relative to said handle and releasable to block rotation of said curling member relative to said handle.

15. A process for curling a lock of hair with a manually operable apparatus composed of a handle, a curling member having a longitudinal axis and two opposed ends spaced apart along the longitudinal axis, the curling member being supported in the handle via one of the ends for rotation relative to the handle about the longitudinal axis and having a manual control member fixed at the other one of the ends, a movable clip for clamping the lock of hair against the curling member, and a blocking member which is manually actuatable to permit rotation of the curling member relative to the handle and releasable to block rotation of the curling member relative to the handle, said process comprising:

immobilizing the lock of hair between the clip and the curling member while the blocking member is released;

grasping the handle in one hand grasping the manual control member in the other hand, actuating the blocking member and rotating the curling member relative to the handle;

effectuating treatment of the lock; and after treatment, separating the lock from the curling member by manually translating the clip on the curling member in a manner that the lock is freely suspended on the clip.

16. Process according to claim 15, wherein the translation movement corresponds to a sliding of the clip along the longitudinal axis of the curling member over a length sufficient to permit complete disengagement of the lock.

17. A hair curling apparatus, for hand-held use, comprising:

a handle (1)

a hair curling member (2) having a longitudinal axis (x–x'), and first and second opposed ends spaced apart along the longitudinal axis, the first end of said curling member being supported by said handle in a manner to permit said curling member to be rotated relative to said handle about the longitudinal axis, and said curling member having a manual control element fixed at the second end for gripping by one hand of a user at least one movable clip (10) for clamping a lock of hair against the curling member (2), wherein the movable clip (10) is mounted in a manner to be freely displaceable on the curling member (2) between two abutment positions to assure extraction of the lock (M') in an initial treatment state; and control and blocking means for selectively blocking or freeing rotation of said curling member relative to said handle.

18. Apparatus according to claim 17 wherein said control and blocking means are manually actuatable to permit rotation of said curling member relative to said handle and releasable to block rotation of said curling member relative to said handle.

* * * * *